US011099494B2

(12) United States Patent
Chiba et al.

(10) Patent No.: US 11,099,494 B2
(45) Date of Patent: Aug. 24, 2021

(54) MAGENTA TONER

(71) Applicant: ZEON CORPORATION, Tokyo (JP)

(72) Inventors: Mayuka Chiba, Tokyo (JP); Hiroshi Nakatani, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 16/494,977

(22) PCT Filed: Mar. 26, 2018

(86) PCT No.: PCT/JP2018/012160
§ 371 (c)(1),
(2) Date: Sep. 17, 2019

(87) PCT Pub. No.: WO2018/181189
PCT Pub. Date: Oct. 4, 2018

(65) Prior Publication Data

US 2020/0285165 A1 Sep. 10, 2020

(30) Foreign Application Priority Data

Mar. 31, 2017 (JP) ..... JP2017-072618

(51) Int. Cl.
*G03G 9/09* (2006.01)
*G03G 9/097* (2006.01)
*G03G 9/087* (2006.01)

(52) U.S. Cl.
CPC ..... *G03G 9/091* (2013.01); *G03G 9/08711* (2013.01); *G03G 9/08782* (2013.01); *G03G 9/092* (2013.01); *G03G 9/09708* (2013.01); *G03G 9/09733* (2013.01); *G03G 9/09791* (2013.01)

(58) Field of Classification Search
CPC ..... G03G 9/092; G03G 9/091; G03G 9/09708
See application file for complete search history.

(56) References Cited

U.S. PATENT DOCUMENTS 6,383,704 B1 * 5/2002 Kataoka ..... G03G 9/08782 430/108.6
6,455,215 B1 9/2002 Hashimoto et al.
6,664,016 B2 * 12/2003 Kanbayashi ..... G03G 9/0821 430/108.23
2002/0048713 A1 * 4/2002 Komoto ..... G03G 9/0836 430/124.1
2004/0241564 A1 * 12/2004 Hidaka ..... G03G 9/08782 430/108.4
2006/0024605 A1 * 2/2006 Koido ..... G03G 9/08782 430/111.4
2009/0047590 A1 * 2/2009 Iga ..... G03G 9/09 430/108.1
2010/0009279 A1 * 1/2010 Hidaka ..... G03G 9/091 430/108.23
2012/0295189 A1 * 11/2012 Zhu ..... G03G 9/09725 430/108.3
2018/0299800 A1 * 10/2018 Ota ..... G03G 9/09328

FOREIGN PATENT DOCUMENTS

JP 3322104 B2 9/2002
JP 3938890 B2 6/2007
JP 2007-206171 A 8/2007
JP 2012-108393 A 6/2012
JP 2013-210449 A 10/2013
JP 2014-186256 A 10/2014

OTHER PUBLICATIONS

English language machine translation of JP 2013-210449. (Year: 2013).*
English translation of International Preliminary Report on Patentability (Chapter I) dated Oct. 10, 2019. Issued in PCT/JP2018/012160.

* cited by examiner

*Primary Examiner* — Christopher D Rodee
(74) *Attorney, Agent, or Firm* — Westerman, Hattori, Daniels & Adrian, LLP

(57) ABSTRACT

Provided is a magenta toner which is more excellent in durability in a high temperature and high humidity environment than conventional ones. The magenta toner comprises a binder resin, a magenta colorant, a release agent and an external additive. The release agent has a maximum endothermic peak in a range of from 70° C. to 80° C. during temperature increase, in a DSC curve measured by a differential scanning calorimeter. Needle-shaped oxide fine particles having an average long diameter of from 30 nm to 500 nm and an aspect ratio of from 4 to 20 are contained therein. Zinc stearate particles having a number average primary particle diameter of from 0.1 μm to 5 μm are contained at an amount of from 0.01 part by mass to 0.5 part by mass with respect to 100 parts by mass of the colored resin particles, as the external additives.

4 Claims, No Drawings

MAGENTA TONER

TECHNICAL FIELD

The present invention relates to a magenta toner which is more excellent in durability in a high temperature and high humidity environment than conventional ones.

BACKGROUND ART

In image forming devices such as an electrophotographic device and an electrostatic recording device, an electrostatic latent image to be formed on a photo conductor is first developed with a toner. Subsequently, a formed toner image is transferred onto a transfer material such as paper if required, and then fixed by various methods such as heating, pressurization or solvent vapor.

In such image forming devices, digital full color copying machines and digital full color printers have been put to practical use. In digital full color copying machines, a color image original is color-separated by each of color filters of blue, green and red, and then electrostatic latent images having a dot diameter of from 20 μm to 70 μm corresponding to the color original are developed using each of toners of yellow, magenta, cyan and black, and a full color image is formed utilizing an action of subtractive color mixing.

In recent years, a demand for higher image quality and higher definition of the full color image has been increasing. In particular, in order to improve color reproducibility, it is desired that printing can be performed with the same hue as printing with ink.

Conventionally, as a coloring pigment for magenta toner, for example, use of an azo pigment such as a monoazo pigment and a disazo pigment or a condensed polycyclic pigment is common, as a magenta colorant.

Patent Literature 1 discloses a magenta toner for electrophotography containing a binder resin and a colorant, wherein the colorant comprises C. I. Pigment Red 57:1, and C. I. Pigment Red 81 or C. I. Pigment Red 122, and the magenta toner contains 0.5 part by weight to 15 parts by weight of C. I. Pigment Red 57:1 and 0.5 part by weight to 15 parts by weight of C. I. Pigment Red 81 or C. I. Pigment Red 122 with respect to 100 parts by weight of the binder resin. Patent Literature 1 describes that a toner having sufficient color developability and a color reproduction region, and having excellent vinyl chloride sheet adhesion resistance, light resistance or storage stability of copy is obtained.

Patent Literature 2 discloses a magenta toner for developing electrostatic images, which contains at least a binder resin and a magenta colorant, wherein the magenta colorant contains both compounds (1) and (2) having a specific chemical structure, and the number average particle diameter of the colorant particles in the toner is from 10 nm to 500 nm. Patent Literature 2 describes that it is possible to obtain a toner which has an excellent charge stability even after the toner is stored in a high temperature and high humidity environment for a long period and then used to output several ten thousand images in a high temperature and high humidity environment.

CITATION LIST

Patent Literature

[Patent Literature 1] JP 3322104 B2
[Patent Literature 2] JP 3938890 B2

SUMMARY OF INVENTION

Technical Problem

The applications of an electrophotographic image forming device have been extended from general copying machines and printers used to print or simply copy office documents, to a field of production of printed matters for use outside the office, specifically, to the print-on-demand (POD) market that is an area of quick printing, since the image forming device can easily print variable information from electronic data.

However, the magenta toners disclosed in Patent Literatures 1 and 2 have problems in durability in a high temperature and high humidity environment, and thus cannot be applied to the various applications.

The present invention is achieved in view of the above actual situation, and an object of the present invention is to provide a magenta toner which is more excellent in durability in a high temperature and high humidity environment than conventional ones.

Solution to Problem

As a result of an extensive study to achieve the object, the present inventors have found that a magenta toner which is more excellent in durability in a high temperature and high humidity environment than conventional ones is obtained, by using a compound A, a compound B, and a compound C each having a specific chemical structure in combination as a magenta colorant, and using a release agent having a maximum endothermic peak in a range of from 70° C. to 80° C. during temperature increase, in a DSC curve measured by a differential scanning calorimeter, and thus accomplished the present invention.

That is, a magenta toner of the present invention comprises a binder resin, a magenta colorant, a release agent and an external additive, wherein a compound A represented by the following general formula (1), a compound B represented by the following general formula (2), and a compound C represented by the following general formula (3) are contained as the magenta colorant, and wherein the release agent has a maximum endothermic peak in a range of from 70° C. to 80° C. during temperature increase, in a DSC curve measured by a differential scanning calorimeter:

General Formula (1)

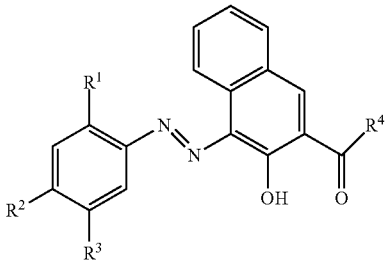

wherein $R^1$ to $R^3$ are each a substituent group selected from the group consisting of a hydrogen atom, an alkyl group, an alkoxy group, a halogen atom, an anilide group and a sulfamoyl group, and $R^4$ is a substituent group selected from the group consisting of a hydroxyl group, an amino group, a substituent group A represented by the following general formula (4), and a substituent group B represented by the following formula (5):

General Formula (4)

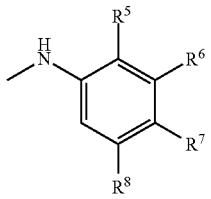

wherein $R^5$ to $R^8$ are each a substituent group selected from the group consisting of a hydrogen atom, a halogen atom, an alkyl group, an alkoxy group and a nitro group, Formula (5)

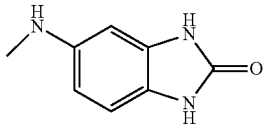

General Formula (2)

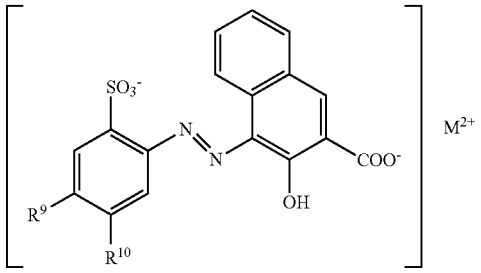

wherein $R^9$ and $R^{10}$ are each a substituent group selected from the group consisting of a hydrogen atom, an alkyl group, a phenyl group and a halogen atom, and M is an element selected from the group consisting of Ba, Ca, Sr, Mn and Mg, General Formula (3)

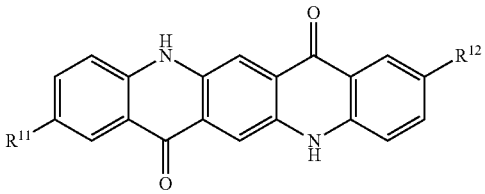

wherein $R^{11}$ and $R^{12}$ are each a substituent group selected from the group consisting of a hydrogen atom, a halogen atom, an alkyl group and an alkoxy group.

In the present invention, it is preferable that a paraffin wax or an ester wax is contained as the release agent.

In the present invention, it is preferable that needle-shaped oxide fine particles having an average long diameter of from 30 nm to 500 nm and an aspect ratio of from 4 to 20 are contained as the external additive.

In the present invention, it is preferable that hydrotalcite having a number average primary particle diameter of from 100 nm to 1000 nm is contained.

In the present invention, it is preferable that inorganic fine particles having a number average primary particle diameter of from 5 nm to 200 nm, except the needle-shaped oxide fine particles and the hydrotalcite, are contained as the external additive.

In the present invention, it is preferable that zinc stearate is contained as the external additive.

In the present invention, it is preferable that the needle-shaped oxide fine particles are titanium oxide.

Advantageous Effects of Invention

According to the present invention as described above, a magenta toner which is more excellent in durability in a high temperature and high humidity environment than conventional ones is provided, by using a compound A, a compound B, and a compound C each having a specific chemical structure in combination as a magenta colorant, and using a release agent having a maximum endothermic peak in a range of from 70° C. to 80° C. during temperature increase, in a DSC curve measured by a differential scanning calorimeter.

DESCRIPTION OF EMBODIMENTS

A magenta toner of the present invention comprises a binder resin, a magenta colorant, a release agent and an external additive, wherein a compound A represented by the following general formula (1), a compound B represented by the following general formula (2), and a compound C represented by the following general formula (3) are contained as the magenta colorant, and wherein the release agent has a maximum endothermic peak in a range of from 70° C. to 80° C. during temperature increase, in a DSC curve measured by a differential scanning calorimeter:

General Formula (1)

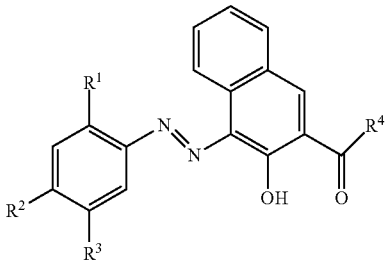

wherein $R^1$ to $R^3$ are each a substituent group selected from the group consisting of a hydrogen atom, an alkyl group, an alkoxy group, a halogen atom, an anilide group and a sulfamoyl group, and $R^4$ is a substituent group selected from the group consisting of a hydroxyl group, an amino group, a substituent group A represented by the following general formula (4), and a substituent group B represented by the following formula (5):

General Formula (4)

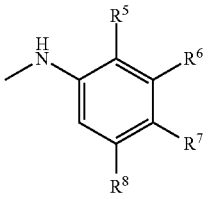

wherein $R^5$ to $R^8$ are each a substituent group selected from the group consisting of a hydrogen atom, a halogen atom, an alkyl group, an alkoxy group and a nitro group, Formula (5)

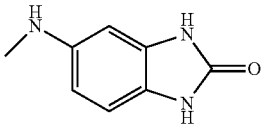

General Formula (2)

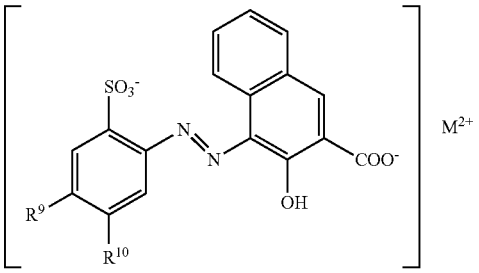

wherein $R^9$ and $R^{10}$ are each a substituent group selected from the group consisting of a hydrogen atom, an alkyl group, a phenyl group and a halogen atom, and M is an element selected from the group consisting of Ba, Ca, Sr, Mn and Mg, General Formula (3)

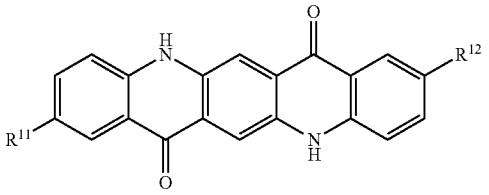

wherein $R^{11}$ and $R^{12}$ are each a substituent group selected from the group consisting of a hydrogen atom, a halogen atom, an alkyl group and an alkoxy group.

Hereinafter, the magenta toner of the present invention may be simply referred as "toner".

Hereinafter, a production method of a magenta colored resin particles which is preferably used in the present invention (hereinafter, sometimes simply referred as "colored resin particles"), the magenta colored resin particles obtained by said production method, a production method of a magenta toner using said magenta colored resin particles, and the magenta toner of the present invention will be described in sequence.

1. Method for Producing Colored Resin Particles

Generally, methods for producing the colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be performed by known methods.

The colored resin particles to be used in the present invention can be produced by employing the wet methods or the dry methods. The wet methods are preferable, and the suspension polymerization method is especially preferable among the wet methods. When the suspension polymerization method is employed, the colored resin particles may be produced by the following processes.

(A) Suspension Polymerization Method (A-1) Preparation Process of Polymerizable Monomer Composition First, a polymerizable monomer, a magenta colorant and a release agent, and in addition, other additives such as a charge control agent and a pigment dispersant as well, which are added if required, are mixed to prepare a polymerizable monomer composition. For example, a media type dispersing machine is used for the mixing in preparation of the polymerizable monomer composition.

In the present invention, the polymerizable monomer means a monomer having a polymerizable functional group, and a binder resin is made by polymerization of the polymerizable monomer. It is preferable to use a monovinyl monomer as a main component of the polymerizable monomer.

Examples of the monovinyl monomer include styrene; styrene derivatives such as vinyltoluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitryl compounds such as acrylonitrile and methacrylonitrile; amide compounds such as acrylamide and methacrylamide; and olefins such as ethylene, propylene and butylene. These monovinyl monomers may be used solely or in combination of two or more kinds. Among them, it is preferable to use styrene, styrene derivative, derivative of acrylic acid or methacrylic acid as a monovinyl monomer.

In order to improve the hot offset and shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids are esterified to alcohol having two or more hydroxyl groups; other divinyl compounds such as N,N-divinylaniline and divinyl ether; and compounds having three or more vinyl groups. These crosslinkable polymerizable monomers can be used solely or in combination of two or more kinds.

It is desirable that the amount of the crosslinkable polymerizable monomer to be used is generally from 0.1 to 5 parts by mass, preferably from 0.3 to 2 parts by mass, with respect to 100 parts by mass of the monovinyl monomer.

Further, the use of a macromonomer as a part of the polymerizable monomer gives rise to a good balance between the shelf stability and low-temperature fixability of the toner, thus being preferable. The macromonomer has a polymerizable carbon-carbon unsaturated double bond at the end of the molecular chain and is a reactive oligomer or polymer which usually has a number average molecular weight of 1,000 to 30,000. It is preferable that the macromonomer can form a polymer having a glass transition temperature (hereinafter sometimes referred as "Tg") higher than that of a polymer obtained by polymerizing a monovinyl monomer.

An used amount of the macromonomer is preferably from 0.03 to 5 parts by mass, more preferably 0.05 to 1 parts by mass with respect to 100 parts by mass of the monovinyl monomer.

In order to obtain the toner of the present invention, the magenta colorant contains the compound A, the compound B, and the compound C.

Hereinafter, the compound A used in the present invention will be described in detail.

The compound A used in the present invention is a monoazo compound represented by the following general formula (1).

General Formula (1)

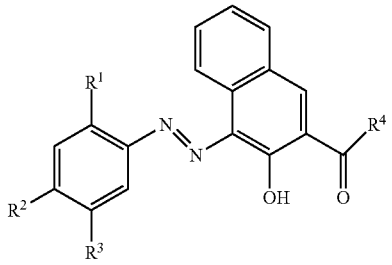

In the general formula (1), $R^1$ to $R^3$ are each a substituent group selected from the group consisting of a hydrogen atom, an alkyl group, an alkoxy group, a halogen atom, an anilide group and a sulfamoyl group. Preferably, $R^1$ is an alkoxy group, $R^2$ is a hydrogen atom or an anilide group, and $R^3$ is a hydrogen atom or an anilide group.

$R^4$ is a substituent group selected from the group consisting of a hydroxyl group, an amino group, a substituent group A represented by the following general formula (4), and a substituent group B represented by the following formula (5). Preferably, $R^4$ is an amino group or a substituent group A represented by the following general formula (4).

General Formula (4)

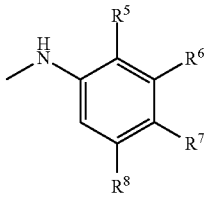

In the general formula (4), $R^5$ to $R^8$ are each a substituent group selected from the group consisting of a hydrogen atom, a halogen atom, an alkyl group, an alkoxy group and a nitro group. Preferably, $R^5$ is an alkoxy group, $R^6$ and $R^7$ are hydrogen atoms, and $R^8$ is a halogen atom.

Formula (5)

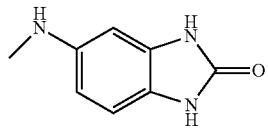

Preferred specific examples of the compound A represented by the general formula (1) include C. I. Pigment Red 269, and C. I. Pigment Red 150.

The compound A used in the present invention is not limited to the above specific examples. Also, tautomers of the above specific examples can be preferably used as a compound of the present invention. As the compound A, a commercially available product can be used, or a compound synthesized in advance can be used.

The content of the compound A is usually from 0.5 part by mass to 15 parts by mass, preferably from 1.0 part by mass to 10 parts by mass, and more preferably from 1.5 parts by mass to 7 parts by mass with respect to 100 parts by mass of the binder resin. When the content of the compound A is 0.5 part by mass or more with respect to 100 parts by mass of the binder resin, it becomes easy to keep the image density high. In addition, when the content of the compound A is 15 parts by mass or less with respect to 100 parts by mass of the binder resin, it is not likely to deteriorate the durability in a high temperature and high humidity environment.

In order to obtain the toner of the present invention, in addition to the compound A, the compound B represented by the following general formula (2) is contained as a magenta colorant.

General Formula (2)

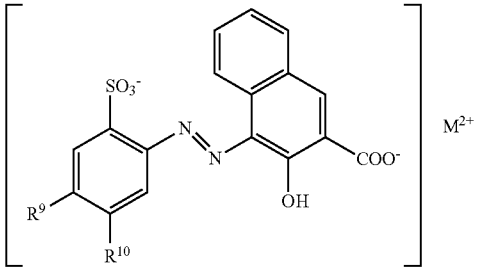

In the general formula (2), $R^9$ and $R^{10}$ are each a substituent group selected from the group consisting of a hydrogen atom, an alkyl group, a phenyl group and a halogen atom. M is an element selected from the group consisting of Ba, Ca, Sr, Mn and Mg. Preferably, $R^9$ is an alkyl group, and $R^{10}$ is a hydrogen atom. Further, M is preferably Ca.

Preferred specific examples of the compound B represented by the general formula (2) include C. I. Pigment Red 57:1.

The content of the compound B is usually from 0.1 part by mass to 8 parts by mass, preferably from 0.2 part by mass to 6 parts by mass, and more preferably from 0.5 part by mass to 3 parts by mass with respect to 100 parts by mass of the binder resin. When the content of the compound B is 0.1 part by mass or more with respect to 100 parts by mass of the binder resin, it becomes easy to keep the image density high. In addition, when the content of the compound B is 8 parts by mass or less with respect to 100 parts by mass of the binder resin, it is not likely to deteriorate the durability in a high temperature and high humidity environment.

In order to obtain the toner of the present invention, in addition to the compound A and the compound B, the compound C represented by the following general formula (3) is contained as a magenta colorant.

General Formula (3)

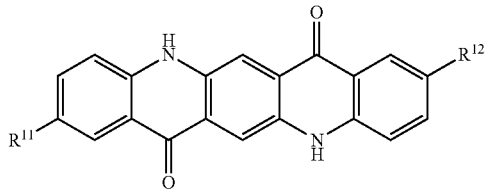

In the general formula (3), $R^{11}$ and $R^{12}$ are each a substituent group selected from the group consisting of a hydrogen atom, a halogen atom, an alkyl group, and an alkoxy group. Preferably, $R^{11}$ and $R^{12}$ are alkyl groups.

Specific examples of the compound C represented by the general formula (3) include C. I. Pigment Red 122, C. I. Pigment Red 192, C. I. Pigment Red 202, and C. I. Pigment Violet 19.

The content of the compound C is usually from 0.5 part by mass to 15 parts by mass, preferably from 1 part by mass to 10 parts by mass, and more preferably from 2 parts by mass to 8 parts by mass with respect to 100 parts by mass of the binder resin. When the content of the compound C is 0.5 part by mass or more with respect to 100 parts by mass of the binder resin, it is not necessary to use a large amount of another colorant, and therefore it is not likely to deteriorate dispersibility of the colorant in the polymerizable monomer. Further, when the content of the compound C is 15 parts by mass or less with respect to 100 parts by mass of the binder resin, it is not likely to deteriorate fixability, and manufacturing cost can be lowered.

In order to obtain the toner of the present invention, the mass ratio of the content of the compound A to the content of the compound B (compound A/compound B) is preferably from 0.5 to 15, more preferably from 1 to 10, and further preferably from 1.5 to 7.

When the mass ratio (compound A/compound B) is 0.5 or more, it becomes easy to maintain the durability in a high temperature and high humidity environment. In addition, when the mass ratio is 15 or less, it becomes easy to keep the image density high.

In the present invention, the mass ratio of the content of the compound A to the content of the compound C (compound A/compound C) is preferably from 0.1 to 8, more preferably from 0.2 to 6, and further preferably from 0.4 to 3.

When the mass ratio (compound A/compound C) is 0.1 or more, it becomes easy to keep the image density high. Moreover, when the mass ratio is 8 or less, it is not likely to deteriorate dispersibility of the colorant in the polymerizable monomer.

In order to obtain the toner of the present invention, the mass ratio of the content of the compound B to the content of the compound C (compound B/compound C) is preferably from 0.1 to 5, more preferably from 0.13 to 3, and further preferably from 0.17 to 1.

When the mass ratio (compound B/compound C) is 0.1 or more, it is not likely to deteriorate dispersibility of the colorant in the polymerizable monomer. When the mass ratio is 5 or less, it becomes easy to maintain the durability in a high temperature and high humidity environment.

The total content of the compound A, the compound B and the compound C is preferably from 3 parts by mass to 30 parts by mass, more preferably from 4 parts by mass to 25 parts by mass, and further preferably from 5 parts by mass to 15 parts by mass with respect to 100 parts by mass of the binder resin.

When the total content of the compound A, the compound B and the compound C is 3 parts by mass or more with respect to 100 parts by mass of the binder resin, the content rate of the magenta colorant in the toner is an appropriate amount, so that it is not likely to lower the image density. On the other hand, when the total content is 30 parts by mass or less, the total content rate of the magenta colorants in the toner is an appropriate amount, so that the fixability is not likely to be deteriorated.

The principle of the effect by using the compound A, the compound B and the compound C in combination is unclear. However, it is thought that the combination use of these compounds makes it possible to exhibit an excellent durability in a high temperature and high humidity environment.

In order to obtain the toner of the present invention, a release agent is added as an additive. By adding a release agent having the following characteristics, not only releasability of the toner from a fixing roll during fixing can be improved, but also excellent durability can be exhibited in a high temperature and high humidity environment.

As a release agent used in the present invention, any release agent can be used without particular limitation as long as it has a maximum endothermic peak in a range of from 70° C. to 80° C. during temperature increase, in a DSC curve measured by a differential scanning calorimeter. The maximum endothermic peak temperature is preferably from 71° C. to 78° C., and particularly preferably from 72° C. to 77° C.

Specific examples of the release agent include an ester wax and a hydrocarbon wax, and the ester wax is preferably a polyfunctional ester wax having an acid value of 2 mg KOH/g or less and a hydroxyl value of 15 mg KOH/g or less. The hydrocarbon wax is preferably a paraffin wax. The use of these waxes as the release agents makes it possible to improve a balance between low-temperature fixability and shelf stability.

For the ester wax suitably used as the release agent in the present invention, a polyfunctional ester wax is more preferable, and examples thereof include: pentaerythritol tetrapalmitate, pentaerythritol tetrastearate, hexaglycerin tetrabehenate tetrapalmitate, hexaglycerin octabehenate, pentaglycerin heptabehenate, tetraglycerin hexabehenate, triglycerin pentabehenate, diglycerin tetrabehenate, glycerin tribehenate, and the like.

For the hydrocarbon wax suitably used as the release agent in the present invention, examples thereof include: polyethylene wax, polypropylene wax, Fischer-Tropsch wax, petroleum wax and the like. Among them, preferred are Fischer-Tropsch wax and petroleum wax, more preferred is petroleum wax.

The number average molecular weight of the hydrocarbon wax is preferably 300 to 800, and more preferably 400 to 600. The penetration of the hydrocarbon wax measured in accordance with JIS K2235 5.4 is preferably 1 to 10, and more preferably 2 to 7.

The petroleum waxes refer to those produced by a refining process of petroleum, that are solid at ordinary temperature mainly composed of saturated hydrocarbon having a side chain, and they are classified into three broad types and and, paraffin waxes, microstaline waxes, and petrolatum, according to JIS K 2235. Further, among the petroleum waxes, a paraffin wax is more preferable from the viewpoint of allowing the balance between low-temperature fixability and shelf stability of the toner to be improved.

As the paraffin wax, various commercial products can be used, and examples of commercial products manufactured by NIPPON SEIRO CO., LTD. include HNP-9 and HNP-10.

In addition to the above release agents, for example, natural waxes such as jojoba wax; and mineral waxes such as ozokerite can be used.

As the release agent, the above-mentioned waxes may be used solely or in combination of two or more kinds. The release agent is used in an amount of preferably from 0.1 part by mass to 30 parts by mass, and further preferably from 1 part by mass to 20 parts by mass, with respect to 100 parts by mass of the monovinyl monomer.

There are no particular limitations on the measurement conditions of the differential scanning calorimeter for determining a temperature indicating the maximum endothermic peak (maximum endothermic peak temperature) of the release agent in the DSC curve, and the maximum endothermic peak temperature can be measured, for example, in accordance with ASTM D3418-82.

In order to improve the charging ability of the toner, a charge control agent having positively charging ability or negatively charging ability can be used as another additive.

The charge control agent is not particularly limited as long as it is generally used as a charge control agent for toner. Among charge control agents, a charge control resin having positively charging ability or negatively charging ability is preferable since the charge control resin is highly compatible with the polymerizable monomer and can impart stable charging ability (charge stability) to the toner particles. From the viewpoint of obtaining a positively-chargeable toner, the charge control resin having positively charging ability is more preferably used.

Examples of the charge control agent having positively charging ability include nigrosine dyes, a quaternary ammonium salts, triaminotriphenylmethane compounds, imidazole compounds, polyamine resins as a charge control resin preferably used, quaternary ammonium group-containing copolymers, and quaternary ammonium salt group-containing copolymers.

Examples of the charge control agent having negatively charging ability include azo dyes containing metals such as Cr, Co, Al and Fe, salicylic acid metal compounds and alkyl salicylic acid metal compounds, and in addition, charge control resins to be preferably used such as sulfonic acid group-containing copolymers, sulfonic acid salt group-containing copolymers, carboxylic acid group-containing copolymers and carboxylic acid salt group-containing copolymers as well.

The charge control agent is used in an amount of, generally 0.01 to 10 parts by mass, preferably 0.03 to 8 parts by mass with respect to 100 parts by mass of the monovinyl monomer. When the added amount of the charge control agent is 0.01 parts by mass or more, fog is not likely to occur. On the other hand, when the added amount of the charge control agent is 10 parts by mass or less, printing soiling is not likely to occur.

It is preferable that the pigment is dispersed in the monomer in the presence of a coupling agent as a pigment dispersant. A surface of the pigment is thereby treated with the coupling agent.

As the coupling agent, silane coupling agent, titanate coupling agent, aluminum coupling agent and the like may be used. Among them, the aluminum coupling agent is preferable. An added amount of the aluminum coupling agent is preferably from 0.05 to 5 parts by mass, more preferably from 0.2 to 4 parts by mass, and still more preferably from 1 to 3 parts by mass, with respect to 100 parts by mass of the magenta colorant. When the coupling agent is 5 parts by mass or less, coagulum, namely a coagulate of particles, is not likely to occur. On the other hand, when the coupling agent is 0.05 parts by mass or more, it is easy to enhance a reflection density and a chroma of the obtained toner.

In addition, it is preferable to use a molecular weight modifier as the other additives, when the polymerizable monomer which becomes a binder resin is polymerized.

The molecular weight modifier is not particularly limited as long as it is generally used as a molecular weight modifier for a toner. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used solely or in combination of two or more kinds.

The molecular weight modifier is used in an amount of generally 0.01 to 10 parts by mass, preferably 0.1 to 5 parts by mass, with respect to 100 parts by mass of the monovinyl monomer.

(A-2) Suspension Process to Obtain Suspension (Droplets Forming Process)

The polymerizable monomer composition comprising a polymerizable monomer and a magenta colorant is dispersed in an aqueous medium containing a dispersion stabilizer, and a polymerization initiator is added therein, then the droplets of the polymerizable monomer composition are formed. The method for forming droplets is not particularly limited. The droplets are formed, for example, by means of a device capable of strong stirring such as an in-line type emulsifying and dispersing machine (product name: MILDER; manufactured by Pacific Machinery & Engineering Co., Ltd), and a high-speed emulsification dispersing machine (product name: T. K. HOMOMIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'- azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylbutanoate, diisopropylperoxydicarbonate, di-t-butylperoxyisophthalate and t-butylperoxyisobutyrate. These can be used solely or in combination of two or more kinds. Among them, the organic peroxides are preferably used since they can reduce residual polymerizable monomer and can impart an excellent printing durability.

Among the organic peroxides, preferred are peroxy esters, and more preferred are non-aromatic peroxy esters, i.e. peroxy esters having no aromatic ring, since they have a good initiator efficiency and can reduce a residual polymerizable monomer.

The polymerization initiator may be added after dispersing the polymerizable monomer composition in the aqueous medium and before forming droplets as described above, or may be added to the polymerizable monomer composition before the polymerizable monomer composition is dispersed in the aqueous medium.

The added amount of the polymerization initiator used in the polymerization of the polymerizable monomer composition is preferably 0.1 to 20 parts by mass, more preferably 0.3 to 15 parts by mass, still more preferably 1 to 10 parts by mass, with respect to 100 parts by mass of the monovinyl monomer.

In the present disclosure, the aqueous medium means a medium containing water as a main component.

The dispersion stabilizer is preferably added to the aqueous medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants; and ampholytic surfactants. These dispersion stabilizers can be used solely or in combination of two or more kinds.

Among the above dispersion stabilizers, colloid of inorganic compounds, particularly colloid of hardly water-soluble metal hydroxide, is preferable. The use of the colloid of inorganic compounds, particularly of hardly water-soluble metal hydroxide makes it possible to narrow a particle size distribution of the colored resin particles and reduce the amount of the dispersion stabilizer remaining after washing, thus the obtained polymerized-toner becomes capable of reproducing clear images, and moreover inhibiting deterioration of environmental stability.

(A-3) Polymerization Process

After the droplets are formed as described in the above (A-2), the obtained aqueous dispersion medium is heated to start polymerization. Thereby, an aqueous dispersion of colored resin particles containing the magenta colorant is formed.

The polymerization temperature of the polymerizable monomer composition is preferably 50° C. or more, more preferably 60 to 95° C. The polymerization reaction time is preferably 1 to 20 hours, more preferably 2 to 15 hours.

The colored resin particle thus obtained may be used as a polymerized toner by adding an external additive which is described below. It is preferable to make the so-called core-shell type (or "capsule type") colored resin particle by using the abovementioned colored resin particle as a core layer and forming a shell layer, which is different from the core layer, around the core layer. The core-shell type colored resin particles can take a balance of lowering fixing temperature and prevention of blocking at storage, since the core layer including a substance having a low softening point is covered with a substance having a higher softening point.

A method for producing the above-mentioned core-shell type colored resin particles using the abovementioned colored resin particles is not particularly limited, and they can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer for forming a shell layer (a polymerizable monomer for shell) and a polymerization initiator are added to an aqueous medium in which the colored resin particles are dispersed, followed by polymerization, thereby the core-shell type colored resin particles can be obtained.

As the polymerizable monomer for shell, the abovementioned polymerizable monomer can be similarly used. Among the polymerizable monomers, any monomer which provides a polymer having Tg of more than 80° C. such as styrene, acrylonitrile and methyl methacrylate is preferably used solely or in combination of two or more kinds.

Examples of the polymerization initiator used for polymerization of the polymerizable monomer for shell include: water-soluble polymerization initiators including metal persulfates such as potassium persulfate and ammonium persulfate; and azo-type initiators such as 2,2'-azobis(2-methyl-N-(2-hydroxyethyl)propionamide) and 2,2'-azobis(2-methyl-N-(1,1-bis(hydroxymethyl)-2-hydroxyethyl) propionamide). These polymerization initiators can be used solely or in combination of two or more kinds. The amount of the polymerization initiator is preferably 0.1 to 30 parts by mass, more preferably 1 to 20 parts by mass, with respect to 100 parts by mass of the polymerizable monomer for shell.

The polymerization temperature of the shell layer is preferably 50° C. or more, more preferably 60 to 95° C. The polymerization reaction time is preferably 1 to 20 hours, more preferably 2 to 15 hours.

(A-4) Processes of Washing, Filtering, Dehydrating and Drying

It is preferable that the aqueous dispersion of the colored resin particles obtained by the polymerization is subjected to operations including filtering, washing for removing the dispersion stabilizer, dehydrating, and drying by several times as needed after the polymerization, according to any conventional method.

In the washing method, when the inorganic compound is used as the dispersion stabilizer, it is preferable that acid or alkali is added to the aqueous dispersion of colored resin particles, thereby the dispersion stabilizer is dissolved in water and removed. When colloid of hardly water-soluble inorganic hydroxide is used as the dispersion stabilizer, it is preferable that acid is added to adjust pH of the aqueous dispersion of colored resin particles to 6.5 or less. Examples of the acid to be added include inorganic acids such as sulfuric acid, hydrochloric acid and nitric acid, and organic acids such as formic acid and acetic acid. Particularly, sulfuric acid is suitable for high removal efficiency and small impact on production facilities.

The methods for dehydrating and filtering are not particularly limited, and any of various known methods can be used. For example, a centrifugal filtration method, a vacuum filtration method and a pressure filtration method can be used. Also, the drying method is not particularly limited, and any of various methods can be used.

(B) Pulverization Method

In the case of producing the colored resin particles by employing the pulverization method, the following processes are performed.

First, a binder resin, a magenta colorant, a release agent and other additives such as a charge control agent etc., which are added if required, are mixed by means of a mixer such as a ball mill, a V type mixer, FM mixer (: product name, manufactured by NIPPON COKE & ENGINEERING CO., LTD.), a high-speed dissolver, an internal mixer or a fallberg. Next, the above-obtained mixture is kneaded while heating by means of a press kneader, a twin screw kneading machine or a roller. The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as an air classifier or an airflow classifier. Thereby, colored resin particles produced by the pulverization method can be obtained.

Incidentally, the binder resin, the magenta colorant, the release agent and other additives such as the charge control agent etc., which are added if required, used in the abovementioned "(A) Suspension polymerization method" can be used in the pulverization method. In like manner of the colored resin particles obtained by the abovementioned "(A) Suspension polymerization method", the colored resin particles obtained by the pulverization method as well can be used in any method such as the in situ polymerization method to produce the core-shell type colored resin particles.

As the binder resin, other resins which are conventionally and broadly used for toners can be used. Specific examples of the binder resin used in the pulverization method include polystyrene, styrene-butyl acrylate copolymers, polyester resins and epoxy resins.

2. Colored Resin Particles

The colored resin particles containing the magenta colorant are obtained by the above production method such as (A) Suspension polymerization method or (B) Pulverization method.

Hereinafter, the colored resin particles constituting the toner will be described. The colored resin particles hereinafter include both core-shell type colored resin particles and colored resin particles which are not core-shell type.

The volume average particle diameter (Dv) of the colored resin particles is preferably 3 to 10 μm, and more preferably 4 to 8 μm. When the volume average particle diameter (Dv) of the colored resin particles is 3 μm or more, it is not likely that a flowability of the polymerized toner is decreased to lead the deterioration of transferability and the decrease of image density. When the volume average particle diameter (Dv) of the colored resin particles is 10 μm or less, a resolution of images is not likely to decrease.

As for the colored resin particles, a ratio (Dv/Dn) of the volume average particle diameter (Dv) and the number average particle diameter (Dn) is preferably 1.0 to 1.3, more preferably 1.0 to 1.2. When "Dv/Dn" is 1.3 or less, it is not likely to cause the decrease of transferability, image density and resolution. The volume average particle diameter and the number average particle diameter of the colored resin particles can be measured, for example, by means of a particle diameter measuring device (product name: MULTISIZER; manufactured by Beckman Coulter, Inc.), etc.

The average circularity of the colored resin particles constituting the toner of the present invention is in a range of, preferably 0.96 to 1.00, more preferably 0.97 to 1.00, and still more preferably 0.98 to 1.00 from the viewpoint of the image reproducibility.

When the average circularity of the colored resin particles is 0.96 or more, the thin line reproducibility in printing is not likely to deteriorate.

3. Method for Producing a Toner

To obtain the toner of the present invention, the external addition is conducted by mixing and stirring the above described colored resin particles containing the magenta colorant with an external additive, thereby the external additive are added on surfaces of the colored resin particles to make an one-component toner. The one-component toner may be further mixed and stirred together with carrier particles to make a two-component toner.

The mixer for performing the external addition is not particularly limited as long as it is a mixer capable of add the external additive on the surface of the colored resin particles. For example, the external addition can be performed by means of a mixing machine capable of mixing and stirring, such as FM MIXER (: product name, manufactured by NIPPON COKE & ENGINEERING CO., LTD.), SUPER MIXER (: product name, manufactured by KAWATA Manufacturing Co., Ltd.), Q MIXER (: product name, manufactured by NIPPON COKE & ENGINEERING CO., LTD.), MECHANOFUSION SYSTEM (: product name, manufactured by Hosokawa Micron Corporation) and MECHANOMILL (: product name, manufactured by Okada Seiko Co., Ltd.).

The external additive used in the present invention is not particularly limited, and examples of the external additive include needle-shaped oxide fine particles, hydrotalcite, inorganic fine particles other than needle-shaped oxide fine particles and hydrotalcite, fatty acid metal salt particles, and organic fine particles comprising polymethyl methacrylate resin, silicone resin, and/or melamine resin.

The needle-shaped oxide fine particles preferably have an average long diameter of from 30 nm to 500 nm. When the average long diameter of the needle-shaped oxide fine particles is in the above range, the effect of the present application is easily obtained. The average long diameter is more preferably from 40 nm to 300 nm, and further preferably from 50 nm to 200 nm. Incidentally, the long diameter refers to a length in an extending direction of the needle-shaped oxide fine particles, and the average long diameter refers to an average of the long diameter.

The aspect ratio of the needle-shaped oxide fine particles is preferably from 4 to 20, more preferably from 4.5 to 15, and further preferably from 5 to 10. Incidentally, the aspect ratio of the needle-shaped oxide fine particle refers to a ratio obtained by dividing the average long diameter of the needle-shaped oxide fine particles, by an average length in a direction perpendicular to the extending direction of the needle-shaped oxide fine particles (average short diameter of the needle-shaped oxide fine particles).

The average long diameter and aspect ratio of the needle-shaped oxide fine particles can be measured, for example, as follows.

First, the long diameter and the short diameter of each needle-shaped oxide fine particle are measured by, for example, TEM or SEM. Thus, the long diameter and short diameter of 30 or more needle-shaped oxide fine particles are measured, and each average value is taken as the average long diameter or average short diameter of the needle-shaped oxide fine particles. A value obtained by dividing the calculated average long diameter by the calculated average short diameter is taken as the aspect ratio of the needle-shaped oxide fine particles.

Examples of the needle-shaped oxide fine particle include titanium oxide, zinc oxide, tin oxide and silica. Among them, the needle-shaped oxide fine particle is preferably titanium oxide and zinc oxide, and more preferably titanium oxide.

The content of the needle-shaped oxide fine particles is preferably from 0.1 part by mass to 3.0 parts by mass, and more preferably from 0.3 part by mass to 2.0 parts by mass with respect to 100 parts by mass of the colored resin particles.

Examples of the inorganic fine particles other than needle-shaped oxide fine particles or hydrotalcite include inorganic fine particles comprising any of silica, titanium oxide, aluminum oxide, tin oxide, calcium carbonate, calcium phosphate, cerium oxide and a mixture of these inorganic substances. Among these, spherical silica fine particles and spherical titanium oxide fine particles are preferable, spherical silica fine particles are more preferable, and spherical colloidal silica fine particles are further preferable.

The number average primary particle diameter of the inorganic fine particles is preferably from 5 nm to 200 nm, more preferably from 5 nm to 150 nm, and further preferably from 7 nm to 100 nm. When the number average primary particle diameter of the inorganic fine particles is in the above range, the effect of the present application is easily obtained.

The content of the inorganic fine particles is preferably from 0.2 part by mass to 5.0 parts by mass, and more preferably from 0.4 part by mass to 3.0 parts by mass with respect to 100 parts by mass of the colored resin particles.

The hydrotalcite, which can be suitably used as an external additive in the present invention, refers to an inorganic compound that generically refers to a natural mineral hydrotalcite ($Mg_6Al_2(OH)_{16}CO_3 \cdot 4H_2O$), and a synthetic hydrotalcite compound having a layered crystal structure similar thereto, and is an inorganic compound represented by the following general formula (6).

$$M1^{2+}{}_xAl_2(OH)_{2x+6nz}(A^{n-})_z \cdot mH_2O \qquad \text{General formula (6):}$$

Here, the symbols in the general formula (6) satisfy the following conditions.

$M1^{2+}$: a divalent metal element represented by, for example, $Mg^{2+}$, $Mn^{2+}$, $Fe^{2+}$, $Co^{2+}$, $Ni^{2+}$, $Cu^{2+}$, and $Zn^{2+}$ $A^{n-}$: a monovalent or divalent anion represented by, for example, $OH^-$, $F^-$, $Cl^-$, $Br^-$, $NO_3^-$, $CO_3^{2-}$, $SO_4^{2-}$, $CH_3COO^-$, $C_2O_42^-$, $ClO_4^-$, and salicylate ions x: a rational number of from 4 to 8 z: an integer of 22 or less when n=1, and an integer of 11 or less when n=2 m: a rational number of 10 or less

Specific examples of the structural formula of hydrotalcite represented by the general formula (6) typically include $Mg_6Al_2(OH)_{16}CO_3 \cdot 4H_2O$, $Mg_{4.5}Al_2(OH)_{13}CO_3 \cdot 3.5H_2O$, $Mg_{4.5}Al_2(OH)_{13}CO_3$, and $Mg_{4.3}Al_2(OH)_{12.6}CO_3 \cdot 3.5H_2O$.

Although the number average primary particle diameter of the hydrotalcite is not particularly limited, it is preferably from 100 nm to 1000 nm, more preferably from 200 nm to 900 nm, and further preferably from 300 nm to 800 nm because an effect of imparting stable charging characteristics with little fluctuation of the charge amount to toner particles is high even in severe environments such as low temperature and low humidity (L/L) and high temperature and high humidity (H/H).

As the hydrotalcite, various commercial products can be used, and examples of commercial products manufactured by Kyowa Chemical Industry Co., Ltd. include DHT-4A and ALCAMIZER 1.

The added amount of the hydrotalcite is preferably from 0.05 part by mass to 2 parts by mass, more preferably from 0.1 part by mass to 1.2 parts by mass, and further preferably from 0.15 to 0.8 with respect to 100 parts by mass of the colored resin particles.

As the fatty acid metal salt particles, metal stearates are preferable, and zinc stearate is more preferable.

As the fatty acid metal salt particles, various commercial products can be used. Examples of commercial products manufactured by SAKAI CHEMICAL INDUSTRY CO., LTD. include SPL-100F (lithium stearate, number average primary particle diameter: 0.7 μm), SPX-100F (magnesium stearate, number average primary particle diameter: 1.0 μm), SPC-100F (calcium stearate, number average primary particle diameter: 0.7 μm), and SPZ-100F (zinc stearate, number average primary particle diameter: 0.5 μm).

The number average primary particle diameter of the fatty acid metal salt particles is preferably from 0.1 μm to 5 μm, more preferably from 0.2 μm to 2 μm, and further preferably from 0.3 μm to 0.8 μm. When the number average primary particle diameter of the fatty acid metal salt particles is in the above range, the effect of the present application is easily obtained.

The content of the fatty acid metal salt particles is from 0.01 part by mass to 0.5 part by mass, preferably from 0.03 part by mass to 0.3 part by mass, and more preferably from 0.05 part by mass to 0.25 part by mass with respect to 100 parts by mass of the colored resin particles.

Incidentally, although these external additives may be used solely, it is preferable to use in combination of two or more kinds.

In order to obtain the toner of the present invention, it is desirable to use an external additive in a proportion of usually from 0.05 part by mass to 6 parts by mass, and preferably from 0.2 part by mass to 5 parts by mass with respect to 100 parts by mass of the colored resin particles. When the added amount of the external additive is 0.05 part by mass or more, a transfer residue is not likely to occur. When the added amount of the external additive is 6 parts by mass or less, fog is not likely to occur.

4. Toner of Present Invention

The toner of the present invention obtained through the processes exemplified above is a magenta toner which comprises a magenta colorant containing a compound A, a compound B, and a compound C each having a specific chemical structure, and a release agent having a maximum endothermic peak in a range of from 70° C. to 80° C. during temperature increase, in a DSC curve measured by a differential scanning calorimeter, in combination, thereby being more excellent in durability in a high temperature and high humidity environment than conventional ones.

EXAMPLES

Hereinafter, the present invention will be described further in detail with reference to examples and comparative examples. However, the present invention is not limited to these examples. Herein, parts and % are based on mass basis unless otherwise noted.

Test methods used in the present examples and comparative examples are as follows.

1. Production of Colored Resin Particles

<Colored Resin Particles (1)>

(1) Preparation of Polymerizable Monomer Composition for Core:

First, 75 parts of styrene and 25 parts of n-butyl acrylate, 0.1 part of a polymethacrylic acid ester macromonomer (product name: AA6, manufactured by TOAGOSEI Co., Ltd., Tg=94° C.), 0.7 part of divinylbenzene, 1.0 part of tetraethylthiuram disulfide, 0.2 part of an aluminum-based coupling agent (product name: PLENACT AL-M, manufactured by Ajinomoto Fine-Techno Co., Inc.), and as magenta pigments, 3.0 parts of C. I. Pigment Red 269 (hereinafter sometimes referred to as PR269) represented by the following formula (1-1), 1.0 part of C. I. Pigment Red 57:1 (hereinafter sometimes referred to as PR57:1) represented by the following formula (2-1) and 4.0 parts of C. I. Pigment Red 122 (hereinafter sometimes referred to as PR122) represented by the following formula (3-1) were wet-pulverized by means of a media type dispersing machine. To the mixture obtained by wet pulverization, 0.75 parts of a charge control resin (product name: ACRYBASE FCA-161P, manufactured by FUJIKURA KASEI CO., LTD.) and 6.0 parts of pentaerythritol tetrastearate (hereinafter may be referred to as ESTER WAX 1) having a maximum endothermic peak observed during temperature increase (hereinafter may be simply referred to as maximum endothermic peak) in a DSC curve measured by a differential scanning calorimeter of 77° C. as a release agent were added, mixed and dissolved to prepare a polymerizable monomer composition.

Incidentally, the maximum endothermic peak of the release agent was determined as follows: in accordance with ASTM D3418-82, a sample was heated at a temperature increase rate of 10° C./min, using a differential scanning calorimeter (manufactured by Seiko Instruments Inc., product name: DSC6220), and the maximum endothermic peak was determined from a DSC curve obtained in the process.

Formula (1-1)

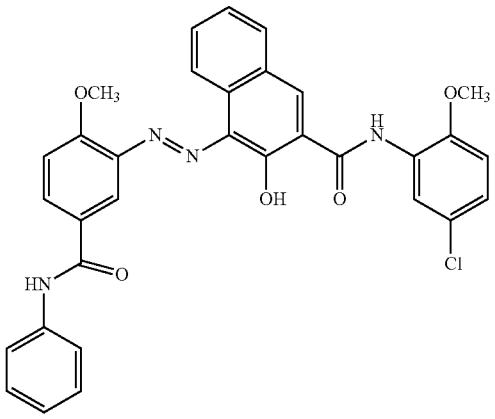

-continued

Formula (2-1)

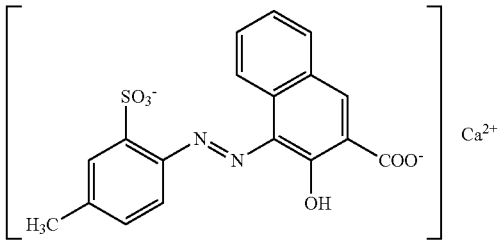

Formula (3-1)

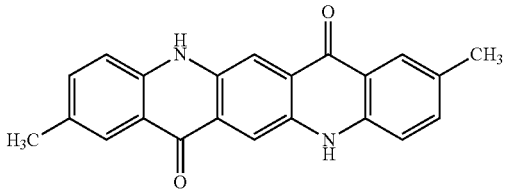

(2) Preparation of Aqueous Dispersion Medium:

On the other hand, an aqueous solution in which 7.3 parts of sodium hydroxide was dissolved in 50 parts of ion exchanged water was gradually added under stirring to an aqueous solution in which 10.4 parts of magnesium chloride was dissolved in 280 parts of ion exchanged water to prepare a magnesium hydroxide colloidal dispersion.

(3) Preparation of Polymerizable Monomer for Shell:

On the other hand, 2 parts of methyl methacrylate and 130 parts of water were finely dispersed by means of an ultrasonic emulsifier to prepare an aqueous dispersion of a polymerizable monomer for shell.

(4) Droplets forming Process:

The polymerizable monomer composition was charged into the magnesium hydroxide colloidal dispersion (magnesium hydroxide colloid amount: 5.3 parts), and the mixture was further stirred, then 6 parts of t-butylperoxy-2-ethyl hexanoate was added thereto as a polymerization initiator. The dispersion to which the polymerization initiator had been added was dispersed at a rotation number of 15,000 rpm by an in-line type emulsifying and dispersing machine (product name: MILDER, manufactured by Pacific Machinery & Engineering Co., Ltd) to form droplets of the polymerizable monomer composition.

(5) Suspension Polymerization Process:

A dispersion containing droplets of the polymerizable monomer composition was placed in a reactor, and the temperature was raised to 90° C. to perform a polymerization reaction. After the polymerization conversion rate reached almost 100%, a solution prepared by dissolving 0.1 part of 2,2'-azobis[2-methyl-N-(2-hydroxyethyl)-propionamide] (product name: VA-086, manufactured by Wako Pure Chemical Industries, Ltd., water-soluble initiator) as a polymerization initiator for shell in the aqueous dispersion of the polymerizable monomer for shell was added to the reactor. Subsequently, polymerization was further continued by maintaining the temperature at 95° C. for 4 hours, and then the reaction was stopped by water cooling to obtain an aqueous dispersion of core-shell type colored resin particles.

(6) Post-Treatment Process:

The aqueous dispersion of colored resin particles was subjected to acid washing by adding sulfuric acid to the extent that pH comes 4.5 or less while stirring (25° C., 10 minutes), and then the colored resin particles separated by filtration were washed with water, and the wash water was filtered. The electric conductivity of the filtrate at this time was 20 μS/cm. Furthermore, the colored resin particles after the washing and filtration process were dehydrated and dried to obtain dried colored resin particles (1).

<Colored Resin Particles (2)>

Colored resin particles (2) were obtained in the same manner as in the method for producing the colored resin particles (1) except that, in "Preparation of Polymerizable Monomer Composition for Core" of the method for producing the colored resin particles (1), PR269 was changed to C. I. Pigment Red 150 represented by the following formula (1-2) (hereinafter sometimes referred to as PR150), and the release agent was changed from ESTER WAX 1 to pentaerythritol tetrapalmitate (hereinafter, may be referred to as ESTER WAX 2) having a maximum endothermic peak of 71° C.

Formula (1-2)

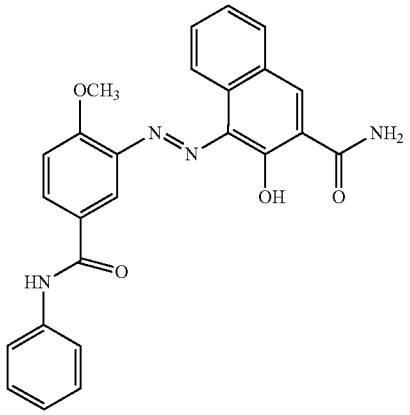

<Colored Resin Particles (3)>

Colored resin particles (3) were obtained in the same manner as in the method for producing the colored resin particles (2) except that, in the method for producing the colored resin particles (2), ESTER WAX 2 was changed to paraffin wax (product name: HNP-9, manufactured by NIPPON SEIRO CO., LTD.) having a maximum endothermic peak of 75° C.

<Colored Resin Particles (4)>

Colored resin particles (4) were obtained in the same manner as in the method for producing the colored resin particles (1) except that, in "Preparation of Polymerizable Monomer Composition for Core" of the method for producing the colored resin particles (1), PR269 was changed to PR150.

<Colored Resin Particles (5)>

Colored resin particles (5) were obtained in the same manner as in the method for producing the colored resin particles (1) except that, in "Preparation of Polymerizable Monomer Composition for Core" of the method for producing the colored resin particles (1), PR57:1 was excluded, and the added amount of PR269 was changed from 3 parts to 4 parts.

<Colored Resin Particles (6)>

Colored resin particles (6) were obtained in the same manner as in the method for producing the colored resin particles (1) except that, in "Preparation of Polymerizable Monomer Composition for Core" of the method for producing the colored resin particles (1), PR122 was excluded, the added amount of PR269 was changed from 3 parts to 5 parts, and the added amount of PR57:1 was changed from 1 part to 3 parts.

<Colored Resin Particles (7)>

Colored resin particles (7) were obtained in the same manner as in the method for producing the colored resin particles (1) except that, in "Preparation of Polymerizable Monomer Composition for Core" of the method for producing the colored resin particles (1), PR269 was excluded, the added amount of PR122 was changed from 4 parts to 5 parts, and the added amount of PR57:1 was changed from 1 part to 3 parts.

<Colored Resin Particles (8)>

Colored resin particles (8) were obtained in the same manner as in the method for producing the colored resin particles (1) except that, in "Preparation of Polymerizable Monomer Composition for Core" of the method for producing the colored resin particles (1), ESTER WAX 1 was changed to pentaerythritol tetrabehenate (hereinafter, may be referred to as ESTER WAX 3) having a maximum endothermic peak of 82° C.

<Colored Resin Particles (9)>

Colored resin particles (9) were obtained in the same manner as in the method for producing the colored resin particles (1) except that, in "Preparation of Polymerizable Monomer Composition for Core" of the method for producing the colored resin particles (1), ESTER WAX 1 was changed to stearyl stearate (hereinafter, may be referred to as ESTER WAX 4) having a maximum endothermic peak of 61° C.

2. Production of Spherical Silica Particles (Inorganic Fine Particles)

In a 3 L glass reactor equipped with a stirrer, a dropping funnel and a thermometer, 623.7 g of methanol, 41.4 g of water, and 49.8 g of 28% aqueous ammonia were added and mixed, and the temperature of the mixed solution was adjusted to be 35° C.

While stirring the mixed solution with the temperature adjusted, dropwise addition of 1250 g of a mixture of tetramethoxysilane and tetrabutoxysilane and dropwise addition of 418.1 g of 5.4% aqueous ammonia were started at the same time. Here, 1250 g of the mixture of tetramethoxysilane and tetrabutoxysilane was added dropwise over 8.5 hours, and the 5.4% aqueous ammonia was added dropwise over 5 hours.

Even after finishing the dropping of the mixture of tetramethoxysilane and tetrabutoxysilane, hydrolysis was performed by further continuing 0.5-hour stirring of the mixed solution to obtain a suspension of spherical silica particles.

Subsequently, an ester adapter and a condenser were mounted on the 3 L glass reactor, and the obtained suspension of spherical silica particles was heated up to a temperature of 60° C. to 70° C. to distill off (distill and remove) methanol. Then, water was added thereto, and the suspension was heated up to a temperature of 70° C. to 90° C. to completely distill off (distill and remove) methanol to obtain an aqueous suspension of spherical silica particles.

While stirring the obtained aqueous suspension of spherical silica particles, dropwise addition of methyltrimethoxysilane was started and 11.6 g of methyltrimethoxysilane was added dropwise over 0.5 hour at room temperature. Even after finishing the dropping, hydrophobizing treatment was performed by further continuing 12-hour stirring of the aqueous suspension.

To the hydrophobizing-treated aqueous suspension, 1440 g of methyl isobutyl ketone was added, then the aqueous suspension was heated up to a temperature of 80° C. to 110° C. An azeotropic mixture was distilled off (distilled and removed) over 10 hours, and then the aqueous suspension was cooled to room temperature.

After 1000 g of methanol was added to the cooled aqueous suspension and the mixture was stirred for 10 minutes, the mixture was processed with a centrifuge at 3000 G for 10 minutes to separate a supernatant liquid. After distilling off the solvents, methyl isobutyl ketone and methanol, from the residual liquid, the obtained matter was dried to obtain spherical silica particles.

To 100 g of the dried spherical silica particles, 10 g of hexamethyldisilazane and 10 g of a compound of the following formula 1 as a cyclic silazane were added as hydrophobizing agents at room temperature. Thereafter, the mixture was heated up to 110° C. and reacted for 3 hours, thereby the spherical silica particles were hydrophobized.

Subsequently, the mixture was heated up to 80° C. under reduced pressure (6650 Pa) to completely distill off (distill and remove) the solvent to prepare spherical silica particles (number average particle diameter: 90 nm, sphericity: 1.12).

3. Production of Magenta Toner

The colored resin particles (1) to (9) were subjected to an external addition treatment to produce magenta toners of Example 1 to Example 9 and Comparative Example 1 to Comparative Example 5.

Example 1

To 100 parts of colored resin particles (1), 1.0 part of spherical silica which is inorganic fine particles obtained in the above production example, 1.0 part of needle-shaped titanium oxide (product name: TTO-V-4, manufactured by ISHIHARA SANGYO KAISHA, LTD., average long diameter: 60 nm, aspect ratio: 6.0) which is needle-shaped oxide fine particles, 0.2 part of hydrotalcite (manufactured by Kyowa Chemical Industry Co., Ltd., product name: DHT-4A, number average primary particle diameter: 400 nm), and 0.2 part of zinc stearate (product name: SPZ-100F, manufactured by SAKAI CHEMICAL INDUSTRY CO., LTD., number average primary particle diameter: 500 nm) which is a fatty acid metal salt were added as external additives, and they were mixed using a high-speed stirrer (product name: FM MIXER, manufactured by NIPPON COKE & ENGINEERING. CO., LTD.) to produce a magenta toner of Example 1.

Example 2

A magenta toner of Example 2 was produced in the same manner as in Example 1 except that, in Example 1, the colored resin particles (1) were changed to the colored resin particles (2).

Example 3

A magenta toner of Example 3 was produced in the same manner as in Example 1 except that, in Example 1, the colored resin particles (1) were changed to the colored resin particles (3).

Example 4

A magenta toner of Example 4 was produced in the same manner as in Example 1 except that, in Example 1, the colored resin particles (1) were changed to the colored resin particles (4), and the needle-shaped oxide fine particles were changed from the needle-shaped titanium oxide to needle-shaped zinc oxide (product name: NZ SERIES (Small Particle), manufactured by SAKAI CHEMICAL INDUSTRY CO., LTD., average long diameter: 100 nm, aspect ratio: 5.0).

Example 5

A magenta toner of Example 5 was produced in the same manner as in Example 1 except that, in Example 1, the spherical silica was not externally added.

Example 6

A magenta toner of Example 6 was produced in the same manner as in Example 1 except that, in Example 1, the zinc stearate was not externally added.

Example 7

A magenta toner of Example 7 was produced in the same manner as in Example 1 except that, in Example 1, the needle-shaped titanium oxide was not externally added and the externally added amount of the spherical silica was changed from 1 part to 2 parts.

Example 8

A magenta toner of Example 8 was produced in the same manner as in Example 1 except that, in Example 1, the hydrotalcite was not externally added.

Example 9

A magenta toner of Example 9 was produced in the same manner as in Example 1 except that, in Example 1, the spherical silica which is inorganic fine particles was changed to silica (product name: TG-820F, manufactured by Cabot Corporation, number average primary particle diameter: 7 nm).

Comparative Example 1

A magenta toner of Comparative Example 1 was produced in the same manner as in Example 1 except that, in Example 1, the colored resin particles (1) were changed to the colored resin particles (5).

Comparative Example 2

A magenta toner of Comparative Example 2 was produced in the same manner as in Example 1 except that, in Example 1, the colored resin particles (1) were changed to the colored resin particles (6).

Comparative Example 3

A magenta toner of Comparative Example 3 was produced in the same manner as in Example 1 except that, in Example 1, the colored resin particles (1) were changed to the colored resin particles (7).

Comparative Example 4

A magenta toner of Comparative Example 4 was produced in the same manner as in Example 1 except that, in Example 1, the colored resin particles (1) were changed to the colored resin particles (8).

Comparative Example 5

A magenta toner of Comparative Example 5 was produced in the same manner as in Example 1 except that, in Example 1, the colored resin particles (1) were changed to the colored resin particles (9).

4. Evaluation of Toner for Developing Electrostatic Images (Printing Durability Test in High Temperature and High Humidity Environment)

Using a commercially-available, non-magnetic one-component development printer, printing sheets were set, and a toner was put in a toner cartridge. The printer was allowed to stand one day and night in a high temperature and high humidity (HH) environment of a temperature of 35° C. and a humidity of 80%, then a continuous printing was performed at a printing density of 5% in the same environment, and the printing density and fog were measured for every 500 sheets. The printing density was measured using a Macbeth reflection densitometer on a solid-printed sheet. The fog was measured as follows.

White solid pattern was printed, and the printer was stopped in the middle, then the toner in a non-image area on a photoconductor after development was adhered to an adhesive tape (product name: SCOTCH MENDING TAPE 810-3-18, manufactured by Sumitomo 3M Limited). The adhesive tape was attached to a new printing sheet, and color tone was measured with a spectrophotometric color difference meter (manufactured by NIPPON DENSHOKU INDUSTRIES CO., LTD., product name: SE-2000).

As a reference, an unused adhesive tape was attached to the same printing sheet, and color tone was similarly measured. Each color tone was represented as coordinates on the L*a*b* space, and a color difference ΔE was calculated from the color tones of the measurement sample and the reference sample to determine a fog value. The smaller fog value indicates that fog is less, and image quality is better.

The evaluation of printing durability was performed up to a number of continuous printing of 15,000 sheets, insofar as being able to maintain an image quality at a printing density of 1.3 or more when the solid pattern was printed and a fog value of 1 or less when the white solid pattern was printed.

The compositions and evaluation results of the magenta toners of Example 1 to Example 9 are shown in Table 1-1, and the compositions and evaluation results of the magenta toners of Comparative Example 1 to Comparative Example 5 are shown in Table 1-2. Incidentally, in Table 1, "15,000<" indicates that the above criteria are satisfied even when printing is continuously performed on 15,000 sheets.

TABLE 1-1

| | Example 1 | Example 2 | Example 3 | Example 4 | Example 5 | Example 6 | Example 7 | Example 8 | Example 9 |
|---|---|---|---|---|---|---|---|---|---|
| Colored resin particle | Colored resin particle (1) | Colored resin particle (2) | Colored resin particle (3) | Colored resin particle (4) | Colored resin particle (1) | Colored resin particle (1) | Colored resin particle (1) | Colored resin particle (1) | Colored resin particle (1) |
| Compound A | P R 269 | P R 150 | P R 150 | P R 150 | P R 269 | P R 269 | P R 269 | P R 269 | P R 269 |
| Added amount (part) | 3 | 3 | 3 | 3 | 3 | 3 | 3 | 3 | 3 |
| Compound B | P R 57: 1 | P R 57: 1 | P R 57: 1 | P R 57: 1 | P R 57: 1 | P R 57: 1 | P R 57: 1 | P R 57: 1 | P R 57: 1 |
| Added amount (part) | 1 | 1 | 1 | 1 | 1 | 1 | 1 | 1 | 1 |
| Compound C | P R 122 | P R 122 | P R 122 | P R 122 | P R 122 | P R 122 | P R 122 | P R 122 | P R 122 |
| Added amount (part) | 4 | 4 | 4 | 4 | 4 | 4 | 4 | 4 | 4 |
| Release agent | ESTER WAX 1 | ESTER WAX 2 | Parrafin wax | ESTER WAX 1 | ESTER WAX 1 | ESTER WAX 1 | ESTER WAX 1 | ESTER WAX 1 | ESTER WAX 1 |
| Added amount (part) | 6 | 6 | 6 | 6 | 6 | 6 | 6 | 6 | 6 |
| Maximum endothermic peak | 77 | 71 | 75 | 77 | 77 | 77 | 77 | 77 | 77 |
| Inorganic particle | Spherical silica | Spherical silica | Spherical silica | Spherical silica | — | Spherical silica | Spherical silica | Spherical silica | Silica |
| Added amount (part) | 1 | 1 | 1 | 1 | — | 1 | 2 | 1 | 1 |
| Needle-shaped oxide | Needle-shaped tinanium oxide | Needle-shaped tinanium oxide | Needle-shaped tinanium oxide | Needle-shaped zinc oxide | Needle-shaped tinanium oxide | Needle-shaped tinanium oxide | — | Needle-shaped tinanium oxide | Needle-shaped tinanium oxide |
| Added amount (part) | 1 | 1 | 1 | 1 | 1 | 1 | — | 1 | 1 |
| Average long diameter | 60 nm | 60 nm | 60 nm | 100 nm | 60 nm | 60 nm | — | 60 nm | 60 nm |
| Aspect ratio | 6 | 6 | 6 | 5 | 6 | 6 | — | 6 | 6 |
| Hydrotalcite | Hydrotalcite | Hydrotalcite | Hydrotalcite | Hydrotalcite | Hydrotalcite | Hydrotalcite | Hydrotalcite | — | Hydrotalcite |
| Added amount (part) | 0.2 | 0.2 | 0.2 | 0.2 | 0.2 | 0.2 | 0.2 | — | 0.2 |
| Fatty acid metal salt | Zinc stearate | Zinc stearate | Zinc stearate | Zinc stearate | Zinc stearate | — | Zinc stearate | Zinc stearate | Zinc stearate |
| Added amount (part) | 0.2 | 0.2 | 0.2 | 0.2 | 0.2 | — | 0.2 | 0.2 | 0.2 |
| Total amount of External additives | 2.4 | 2.4 | 2.4 | 2.4 | 1.4 | 2.2 | 2.4 | 2.2 | 2.4 |

TABLE 1-1-continued

| | Example 1 | Example 2 | Example 3 | Example 4 | Example 5 | Example 6 | Example 7 | Example 8 | Example 9 |
|---|---|---|---|---|---|---|---|---|---|
| Durability after leaving in H/H | 15000< | 13000 | 14000 | 15000< | 11000 | 13000 | 10000 | 12000 | 13000 |

TABLE 1-2

| | Comparative Example 1 | Comparative Example 2 | Comparative Example 3 | Comparative Example 4 | Comparative Example 5 |
|---|---|---|---|---|---|
| Colored resin particle | Colored resin particle (5) | Colored resin particle (6) | Colored resin particle (7) | Colored resin particle (8) | Colored resin particle (9) |
| Compound A | P R 269 | P R 269 | — | P R 269 | P R 269 |
| Added amount (part) | 4 | 5 | — | 3 | 3 |
| Compound B | — | P R 57:1 | P R 57:1 | P R 57:1 | P R 57:1 |
| Added amount (part) | — | 3 | 3 | 1 | 1 |
| Compound C | P R 122 | — | P R 122 | P R 122 | P R 122 |
| Added amount (part) | 4 | — | 5 | 4 | 4 |
| Release agent | ESTER WAX 1 | ESTER WAX 1 | ESTER WAX 1 | ESTER WAX 3 | ESTER WAX 4 |
| Added amount (part) | 6 | 6 | 6 | 6 | 6 |
| Maximum endothermic peak | 77 | 77 | 77 | 82 | 61 |
| Inorganic particle | Spherical silica | Spherical silica | Spherical silica | Spherical silica | Spherical silica |
| Added amount (part) | 1 | 1 | 1 | 1 | 1 |
| Needle-shaped oxide | Needle-shaped tinanium oxide | Needle-shaped tinanium oxide | Needle-shaped tinanium oxide | Needle-shaped tinanium oxide | Needle-shaped tinanium oxide |
| Added amount (part) | 1 | 1 | 1 | 1 | 1 |
| Average long diameter | 60 nm | 60 nm | 60 nm | 60 nm | 60 nm |
| Aspect ratio | 6 | 6 | 6 | 6 | 6 |
| Hydrotalcite | Hydrotalcite | Hydrotalcite | Hydrotalcite | Hydrotalcite | Hydrotalcite |
| Added amount (part) | 0.2 | 0.2 | 0.2 | 0.2 | 0.2 |
| fatty acid metal salt | Zinc stearate | Zinc stearate | Zinc stearate | Zinc stearate | Zinc stearate |
| Added amount (part) | 0.2 | 0.2 | 0.2 | 0.2 | 0.2 |
| Total amount of External additives | 2.4 | 2.4 | 2.4 | 2.4 | 2.4 |
| Durability after leaving in H/H | 9000 | 7000 | 8000 | 9000 | 8000 |

5. Summary of Toner Evaluation

As shown in Table 1-2, it has been found that the magenta toner of Comparative Example 1 in which the colored resin particles do not contain the compound B as a magenta colorant, the magenta toner of Comparative Example 2 in which the colored resin particles do not contain the compound C as a magenta colorant, and the magenta toner of Comparative Example 3 in which the colored resin particles do not contain the compound A as a magenta colorant are inferior in printing durability in a high temperature and high humidity environment since the number of sheets evaluated in the printing durability test in a high temperature and high humidity environment is as low as 7,000 to 9,000.

The toners of Comparative Examples 1 to 3 are considered to be inferior in durability in a high temperature and high humidity environment because they do not contain any one of the compound A, the compound B, and the compound C as a magenta colorant.

Also, as shown in Table 1-2, it has been found that the magenta toner of Comparative Example 4 in which the colored resin particles contain all of the compound A, the compound B, and the compound C as magenta colorants, but contain the ESTER WAX 3 having a maximum endothermic peak at 82° C. as a release agent, and the magenta toner of Comparative Example 5 in which the colored resin particles contain all of the compound A, the compound B, and the compound C as magenta colorants, but contain the ESTER WAX 4 having a maximum endothermic peak at 61° C. as a release agent, are inferior in printing durability in a high temperature and high humidity environment since the number of sheets evaluated in the printing durability test in a high temperature and high humidity environment is as low as 8,000 to 9,000.

The toners of Comparative Examples 4 and 5 are considered to be inferior in durability in a high temperature and high humidity environment because they contain a release agent that does not have a maximum endothermic peak in a range of from 70° C. to 80° C.

On the other hand, as shown in Table 1-1, it has been found that the magenta toners of Examples 1 to 9 in which the colored resin particles contain all of the compound A, the compound B, and the compound C as magenta colorants, and also contain the ESTER WAX 1 having a maximum endothermic peak at 77° C., the ESTER WAX 2 having a maximum endothermic peak at 71° C., or the paraffin wax having a maximum endothermic peak at 75° C. as a release agent are excellent in printing durability in a high temperature and high humidity environment since the number of sheets evaluated in the printing durability test in a high temperature and high humidity environment is as high as 10,000 or more.

In addition, from the comparison between Example 1 and Examples 5 to 8, it has been found that, when the inorganic fine particles, the needle-shaped oxide fine particles, hydrotalcite, and zinc stearate are contained as the external additives, the number of sheets evaluated in the printing durability test in a high temperature and high humidity environment increases, and the magenta toner is further excellent in printing durability in a high temperature and high humidity environment.

From the above results, it has been found that a magenta toner comprising a binder resin, a magenta colorant, a release agent, and an external additive, wherein the compound A represented by the general formula (1), the compound B represented by the general formula (2), and the compound C represented by the general formula (3) are contained as the magenta colorants, and wherein the release agent has a maximum endothermic peak in a range of from 70° C. to 80° C. during temperature increase, in a DSC curve measured by a differential scanning calorimeter, is excellent in durability in a high temperature and high humidity environment.

The invention claimed is:

1. A magenta toner comprising colored resin particles which comprise:

a binder resin;

a magenta colorant comprising a compound A, a compound B and a compound C;

a release agent; and an external additive present on the colored resin particles, the external additive comprising: needle-shaped oxide fine particles; hydrotalcite; other inorganic fine particles than the needle-shaped oxide fine particles and the hydrotalcite; and zinc stearate particles, wherein the compound A represented by the following general formula (1) in a range of from 1.0 part by mass to 15.0 part by mass with respect to 100 parts by mass of the binder resin, the compound B represented by the following general formula (2) in a range of from 0.1 part by mass to 8.0 part by mass with respect to 100 parts by mass of the binder resin, and the compound C represented by the following general formula (3) in a range of from 0.5 part by mass to 15.0 part by mass with respect to 100 parts by mass of the binder resin are contained as the magenta colorant, wherein a mass ratio of a content of the compound A to a content of the compound B (compound A/ compound B) is from 1 to 15, wherein the release agent has a maximum endothermic peak in a range of from 70° C. to 80° C. during temperature increase, in a DSC curve measured by a differential scanning calorimeter, wherein the needle-shaped oxide fine particles having an average long diameter of from 30 nm to 500 nm and an aspect ratio of from 4 to 20 are contained at an amount of from 0.1 part by mass to 3.0 parts by mass with respect to 100 parts by mass of the colored resin particles, the hydrotalcite having a number average primary particle diameter of from 100 nm to 1000 nm are contained at an amount of from 0.05 part by mass to 2 parts by mass with respect to 100 parts by mass of the colored resin particles, other inorganic fine particles than the needle-shaped oxide fine particles and the hydrotalcite having a number average primary particle diameter of from 5 nm to 200 nm are contained at an amount of from 0.2 part by mass to 5.0 parts by mass with respect to 100 parts by mass of the colored resin particles, and zinc stearate particles having a number average primary particle diameter of from 0.1 μm to 5 μm are contained at an amount of from 0.01 part by mass to 0.5 part by mass with respect to 100 parts by mass of the colored resin particles, as the external additives, General Formula (1)

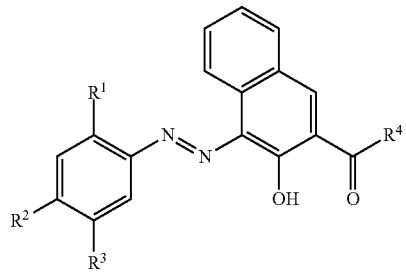

wherein $R^1$ to $R^3$ are each a substituent group selected from the group consisting of a hydrogen atom, an alkyl group, an alkoxy group, a halogen atom, an anilide group and a sulfamoyl group, and $R^4$ is a substituent group selected from the group consisting of a hydroxyl group, an amino group, a substituent group A represented by the following general formula (4), and a substituent group B represented by the following formula (5):

General Formula (4)

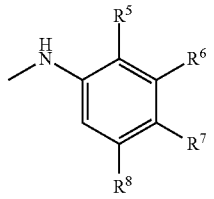

wherein $R^5$ to $R^8$ are each a substituent group selected from the group consisting of a hydrogen atom, a halogen atom, an alkyl group, an alkoxy group and a nitro group, Formula (5)

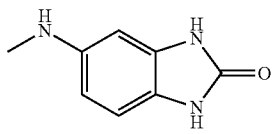

General Formula (2)

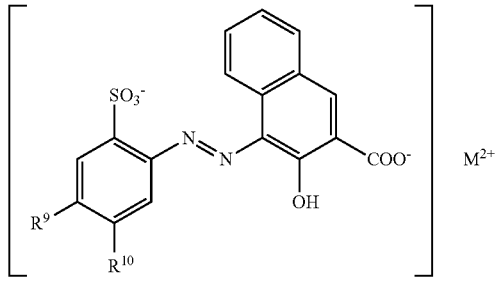

wherein $R^9$ and $R^{10}$ are each a substituent group selected from the group consisting of a hydrogen atom, an alkyl group, a phenyl group and a halogen atom, and M is an element selected from the group consisting of Ba, Ca, Sr, Mn and Mg, General Formula (3)

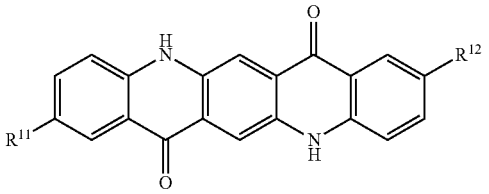

wherein $R^{11}$ and $R^{12}$ are each a substituent group selected from the group consisting of a hydrogen atom, a halogen atom, an alkyl group and an alkoxy group.

2. The magenta toner according to claim 1, wherein a paraffin wax or an ester wax is contained as the release agent.

3. The magenta toner according to claim 1, wherein the needle-shaped oxide fine particles are titanium oxide.

4. The magenta toner according to claim 1, wherein the paraffin wax is contained as the release agent.

* * * * *